US009234637B2

(12) United States Patent
Jonsson

(10) Patent No.: US 9,234,637 B2
(45) **Date of Patent: *Jan. 12, 2016**

(54) EMITTING LIGHT USING MULTIPLE PHOSPHORS

(71) Applicant: Greenwave Systems, PTE. LTD., Singapore (SG)

(72) Inventor: Karl S. Jonsson, Rancho Santa Margarita, CA (US)

(73) Assignee: Greenwave PTE. LTD., Singapore (SG)

( * ) Notice: Subject to any disclaimer, the term of this patent is extended or adjusted under 35 U.S.C. 154(b) by 0 days.

This patent is subject to a terminal disclaimer.

(21) Appl. No.: 14/293,682

(22) Filed: Jun. 2, 2014

(65) Prior Publication Data

US 2014/0286036 A1 Sep. 25, 2014

Related U.S. Application Data

(63) Continuation of application No. 12/838,802, filed on Jul. 19, 2010, now Pat. No. 8,764,210.

(51) Int. Cl.
*F21V 9/16* (2006.01)
*F21K 99/00* (2010.01)
(Continued)

(52) U.S. Cl.
CPC ... *F21K 9/56* (2013.01); *F21K 9/52* (2013.01); *F21V 14/003* (2013.01); *F21Y 2101/02* (2013.01)

(58) Field of Classification Search
CPC ..... F21Y 2101/02; F21K 9/56
USPC ..... 362/84
See application file for complete search history.

(56) References Cited

U.S. PATENT DOCUMENTS 4,612,670 A 9/1986 Henderson
4,727,457 A 2/1988 Thillays
(Continued)

FOREIGN PATENT DOCUMENTS

JP 06260287 A 9/1994
JP 2001185371 A 7/2001
(Continued)

OTHER PUBLICATIONS

"First LED Replacement Bulb Unveiled", Photonics.com, May 12, 2010, http://www.photonics.com/Article.aspx? AID=42190, retrieved Jul. 7, 2010.
(Continued)

*Primary Examiner* — Anh Mai
*Assistant Examiner* — Hana Featherly
(74) *Attorney, Agent, or Firm* — Bruce A. Young

(57) ABSTRACT

A light emitting apparatus includes a light emitting device, fixedly situated at a first position, to emit light at a wavelength, a first phosphor, fixedly situated at a second position, to radiate light with a first spectral characteristic out of the light emitting apparatus in response to irradiation by the light at the wavelength, and a second phosphor, fixedly situated at a third position, to radiate light with a second spectral characteristic out of the light emitting apparatus in response to irradiation by the light at the wavelength. An optical coupling mechanism is included to optically couple the light emitting device to the first phosphor and to optically decouple the light emitting device from the second phosphor in a first operating mode, and optically couple the light emitting device to the second phosphor in a second operating mode.

19 Claims, 9 Drawing Sheets

(51) Int. Cl.
*F21V 14/00* (2006.01)
*F21Y 101/02* (2006.01)

(56) References Cited

U.S. PATENT DOCUMENTS

| | | | | |
|---|---|---|---|---|
| 5,534,709 | A | 7/1996 | Yoshimoto et al. | |
| 5,813,753 | A | 9/1998 | Vriens et al. | |
| 7,109,514 | B2 | 9/2006 | Tazaki et al. | |
| 7,256,057 | B2 | 8/2007 | Schardt et al. | |
| 7,956,546 | B2 | 6/2011 | Hasnain | |
| 8,013,545 | B2 | 9/2011 | Jonsson | |
| 8,200,390 | B2 | 6/2012 | Brown et al. | |
| 8,421,376 | B2 | 4/2013 | Jonsson | |
| 8,531,137 | B2 | 9/2013 | Jonsson | |
| 2003/0193813 | A1* | 10/2003 | Collins | 362/465 |
| 2004/0165245 | A1 | 8/2004 | Carlson et al. | |
| 2005/0200934 | A1 | 9/2005 | Callahan et al. | |
| 2006/0110166 | A1* | 5/2006 | Allen | 398/183 |
| 2007/0019408 | A1 | 1/2007 | Mcguire et al. | |
| 2008/0224631 | A1 | 9/2008 | Melanson | |
| 2009/0034284 | A1 | 2/2009 | Li et al. | |
| 2009/0076329 | A1 | 3/2009 | Su et al. | |
| 2009/0103166 | A1 | 4/2009 | Khazeni et al. | |
| 2009/0166584 | A1 | 7/2009 | Shimooka et al. | |
| 2009/0195186 | A1* | 8/2009 | Guest et al. | 315/294 |
| 2009/0284148 | A1 | 11/2009 | Iwanaga | |
| 2009/0315480 | A1 | 12/2009 | Yan et al. | |
| 2010/0046234 | A1* | 2/2010 | Abu-Ageel | 362/308 |
| 2010/0084992 | A1 | 4/2010 | Valois et al. | |
| 2010/0097779 | A1 | 4/2010 | Gladnick et al. | |
| 2010/0165599 | A1 | 7/2010 | Allen | |
| 2010/0265707 | A1 | 10/2010 | Van Herpen et al. | |
| 2011/0042706 | A1 | 2/2011 | Tanaka et al. | |
| 2011/0063864 | A1 | 3/2011 | Brown et al. | |
| 2011/0095687 | A1 | 4/2011 | Jonsson | |
| 2011/0309735 | A1 | 12/2011 | Parker et al. | |
| 2011/0315878 | A1 | 12/2011 | Vizgaitis | |
| 2012/0013238 | A1 | 1/2012 | Jonsson | |
| 2012/0014086 | A1 | 1/2012 | Jonsson | |
| 2012/0126699 | A1 | 5/2012 | Zittel | |
| 2012/0152273 | A1 | 6/2012 | Kergosien et al. | |

FOREIGN PATENT DOCUMENTS

| | | | |
|---|---|---|---|
| JP | 2001307505 | A | 11/2001 |
| JP | 2006172820 | A | 6/2006 |
| JP | 2006525640 | A | 11/2006 |
| JP | 2008123737 | A | 5/2008 |
| KR | 1020020034855 | A | 5/2002 |
| KR | 2009009465 | A | 1/2009 |
| WO | 03026358 | A1 | 3/2003 |

OTHER PUBLICATIONS

Emma Ritch, "Philips launches its first mainstream LED light", Cleantech Group, Feb. 20, 2009, http://cleantech.com/news/4197/philips-launches-first-mainstream-led, retrieved on Jul. 7, 2010.

Michael Kanellow, "Philips LED Bulb to Cost Around $60", Greentech Media, May 12, 2010, http://www.greentechmedia.com/articles/read/philips-led-bulb-to-cost-around-60/, retrieved on Jul. 7, 2010.

Rhee Seokjae, "Energy Saving Bulb", Bugs' Design Lab. Blog, Dec. 2008, http://bugsrhee.blogspot.com/2009/03/ecobulb.html, retrieved on Jul. 7, 2010.

Steve Bush, "Philips Fortimo white light uses separate phosphor plate", Electronics Weekly, May 30, 2008, http://www.electronicsweekly.com/Articles/2008/05/30/43838/philips-fortimo-white-light-uses-separate-phosphor-plate.htm, retrieved Jul. 7, 2010.

USPTO, Notice of Allowance for U.S. Appl. No. 12/838,743, May 5, 2014.

USPTO, Non-Final Office Action for U.S. Appl. No. 14/453,398.

* cited by examiner

EMITTING LIGHT USING MULTIPLE PHOSPHORS

BACKGROUND

1. Technical Field

The present subject matter relates to generating light using phosphors. More specifically it related to LED devices utilizing phosphors.

2. Description of Related Art

Current multi-colored light sources that utilize LEDs use multiple LEDs. In the simplest case, a dual color LED is comprised of two LEDs, each of which emits a different color of light. They can be packaged together in one package with connections that may be separate or shared. A more capable multi-colored light source utilizing LEDs may be built using a plurality of LEDs of a variety of colors, commonly some number each of red, green and blue LEDs. A controller may be included that can individually control the intensity of each color of LED or even control the intensity of each individual LED. This allows the controller to generate a wide variety of colors.

A conventional LED die generally emits light in a narrow band of wavelengths. If that wavelength is in the visible range, this gives the LED a distinct color to a human eye. To generate a broader spectrum of light, such as needed to generate a light perceived as "white" by the human eye, a technique may be used where a narrow range of wavelengths generated by a single LED die irradiates and excites a phosphor material to produce visible light, referred to herein as a phosphor LED (or PLED). The phosphor can comprise a mixture or combination of distinct phosphor materials, and the light emitted by the phosphor can include a plurality of narrow emission lines distributed over the visible wavelength range such that the emitted light appears substantially white to the human eye.

One example of a phosphor LED is a blue LED illuminating a phosphor that converts blue to both red and green wavelengths. A portion of the blue excitation light is not absorbed by the phosphor, and the residual blue excitation light is combined with the red and green light emitted by the phosphor. Another example of a phosphor LED is an ultraviolet (UV) LED illuminating a phosphor that absorbs and converts UV light to red, green, and blue light.

Different combinations of distinct phosphor materials may give off subtle variations of spectra to emit "white" light at different color temperatures. The correlated color temperature (simply referred to as color temperature herein) of a light source is the temperature of an ideal black-body radiator that radiates light that is perceived by the human eye to be of a comparable hue to that light source. The temperature is conventionally stated in units of absolute temperature, kelvin (K). Higher color temperatures (5000K or more) are called cool colors (blueish white); lower color temperatures (2700-3000K) are called warm colors (yellowish white through red). While light with a wide range of color temperatures may still be called "white", in reality a white light at 6000K (similar to typical daylight) is actually a different color than a white light at 3000K (similar to an incandescent bulb) or a white light at 9000K (similar to a computer CRT screen). Thus an application needing to adjust the color temperature of a light source may actually require a multi-color light source.

Many applications today would like to be able to adjust the color of the light source or the color temperature of a white light source for its artistic or psychological effects. For non-LED based lighting sources, this has often been done with filters or gels placed over conventional lights. With a variety of filters, a wide variety of different colors (including different color temperatures) can be realized from a conventional lamp. Multi-colored LED light sources utilizing several different colors of LEDs have become popular due to the wide range and fine control that can be achieved using the controller. But if a limited range of finely controlled colors is required, a full set of LEDs with their associated controller may be too expensive and bulky for many applications and even then, the limited spectral content available from LEDs may not provide the ability to create subtle differences in perceived color such as slight variations in color temperature.

BRIEF DESCRIPTION OF THE DRAWINGS

The accompanying drawings, which are incorporated in and constitute part of the specification, illustrate various embodiments of the invention. Together with the general description, the drawings serve to explain the principles of the invention. They should not, however, be taken to limit the invention to the specific embodiment(s) described, but are for explanation and understanding only. In the drawings.

DETAILED DESCRIPTION

Figure 1A:
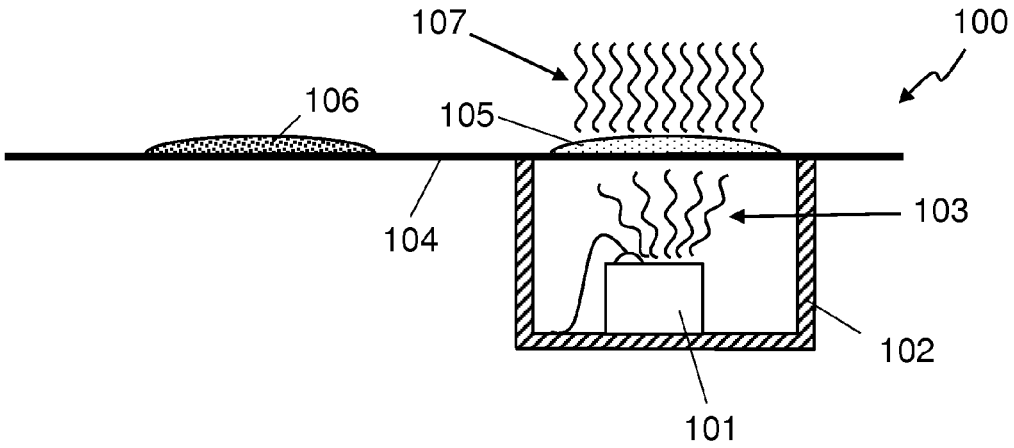
FIGS. 1A and 1B show an embodiment of a dual phosphor LED in two different operating modes.

In the following detailed description, numerous specific details are set forth by way of examples in order to provide a thorough understanding of the relevant teachings. However, it should be apparent to those skilled in the art that the present teachings may be practiced without such details. In other instances, well known methods, procedures and components have been described at a relatively high-level, without detail, in order to avoid unnecessarily obscuring aspects of the present concepts. A number of descriptive terms and phrases are used in describing the various embodiments of this disclosure. These descriptive terms and phrases are used to convey a generally agreed upon meaning to those skilled in the art unless a different definition is given in this specification. Some descriptive terms and phrases are presented in the following paragraphs for clarity.

As used herein, the term "coupled" includes direct and indirect connections. Moreover, where first and second devices are coupled, intervening devices including active devices may be located there between.

The term "LED" refers to a diode that emits light, whether visible, ultraviolet, or infrared, and whether coherent or incoherent. The term as used herein includes incoherent polymer-encased semiconductor devices marketed as "LEDs", whether of the conventional or super-radiant variety. The term as used herein also includes semiconductor laser diodes and diodes that are not polymer-encased. It also includes LEDs that include a phosphor or nanocrystals to change their spectral output. It can also include organic LEDs.

The term "visible light" refers to light that is perceptible to the unaided human eye, generally in the wavelength range from about 400 to about 700 nm.

The term "ultraviolet" or "UV" refers to light whose wavelength is in the range from about 200 to about 400 nm.

The term "white light" refers to light that stimulates the red, green, and blue sensors in the human eye to yield an appearance that an ordinary observer would consider "white". Such light may be biased to the red (commonly referred to as a warm color temperature) or to the blue (commonly referred to as a cool color temperature).

The terms "spectral characteristic" and "spectral composition" may be used interchangeably and refer to the set of wavelengths of electromagnetic radiation that combine to make up a particular light source. Light sources that may be perceived as having the same color may comprise different spectral characteristics. For example a light that is perceived as orange may have a spectral characteristic of a single peak at about 600 nm or may have a spectral characteristic with two peaks, one at approximately 500 nm and one at approximately 700 nm. Each wavelength may have a different associated intensity. Two spectral characteristics may be considered substantially similar even if an additional wavelength or small set of wavelengths is present in one but not in the other.

Reference now is made in detail to the examples illustrated in the accompanying drawings and discussed below.

Figure 1B:
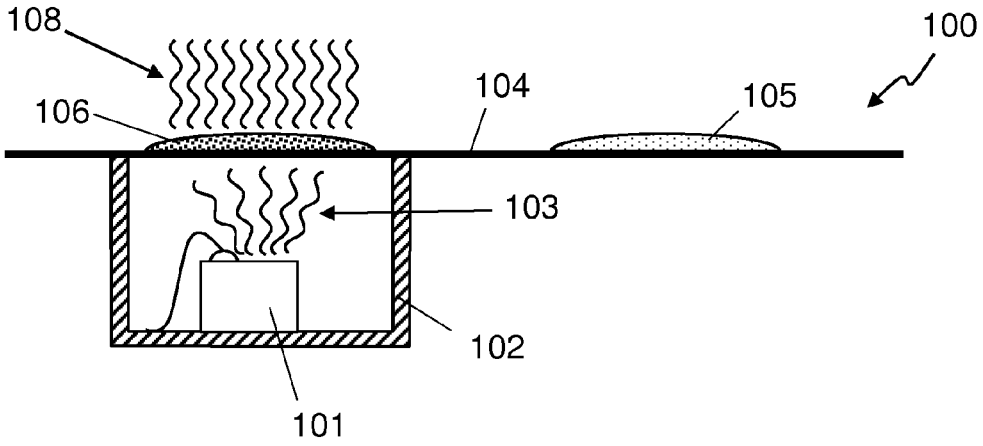

FIG. 1A shows a cross-sectional view of an embodiment of a dual phosphor LED 100 in a first operating mode and FIG. 1B shows the cross sectional view of the embodiment of the dual phosphor LED 100 in a second operating mode. A light emitting device, shown in the embodiment of FIGS. 1A and 1B as an LED 101, is mounted in a case 102 and emits light 103 at a wavelength. In other embodiments, the light emitting device may be a plurality of LEDs. In yet other embodiments, the light emitting device may be an incandescent light, a fluorescent light, a halogen light, an arc-light, or any other device for emitting light. The embodiments described later in this disclosure refer to an LED as the light emitting device but this should not be taken as a limitation. The case 102 may include a reflector to help direct the light 103 out of the case 102 and/or heat sink for the LED 101. In some embodiments, no case may be required. A carrier 104 is positioned in the path of the light 103. A first phosphor 105 is positioned on the carrier at a first position and a second phosphor 106 is positioned on the carrier at a second position. FIG. 1A shows the first operating mode wherein the carrier 104 is positioned so that the light 103 from the LED 101 is optically coupled to the first phosphor 105 which may emit light with a first spectral characteristic 107. FIG. 1B shows the second operating mode wherein the carrier 104 is positioned so that the light 103 from the LED 101 is optically coupled to the second phosphor 106 which may emit light with a second spectral characteristic 108. Some embodiments may continue to optically couple the first phosphor 105 to the LED even in the second operating mode while the second phosphor 106 is optically coupled to the LED 101. A controller may also be provided to receive a selection input of the desired spectral characteristic and control the optical coupling of the LED 101 and the phosphors 105, 106.

The light 103 emitted by the LED 101 may be comprised of a single wavelength of light or can be a spectrum of wavelengths of light. An embodiment may use light 103 of any wavelength depending on the sensitivities of the phosphors 105, 106 used. In one embodiment the light 103 may be blue or violet visible light with a wavelength of about 500 nm to about 400 nm. In another embodiment, the light 103 may be ultraviolet light with a wavelength of about 400 nm to about 200 nm. The light emitted from the dual phosphor LED 100 may have substantially the same spectral characteristic of the light 107 emitted by the first phosphor 105 or the light 108 emitted by the second phosphor 106 depending on which operating mode the dual phosphor LED is in, but may also include additional peaks of the wavelength of the light 103 generated by the LED 101. In some embodiments, the first spectral characteristic of the light 107 emitted by the first phosphor 105 may be perceived by the unaided human eye to be a first color and the second spectral characteristic of the light 108 emitted by the second phosphor 106 may be perceived by the unaided human eye as a second color. The first color and the second color may be different colors in some embodiments or they may be seen as slight variations of the same color. In one embodiment, the first spectral characteristic of the light 107 emitted by the first phosphor 105 may be perceived by the unaided human eye to be white light with a first color temperature and the second spectral characteristic of the light 108 emitted by the second phosphor 106 may be perceived by the unaided human eye as white light with a second color temperature. In one embodiment the first color temperature may be warm and the second color temperature may be cool. In another embodiment, the first color temperature may be similar to that of an incandescent light and the second color temperature may be similar to that of daylight. Any two different spectral characteristics 107, 108 may be generated by the two phosphors with differences between the two spectral characteristics 107, 108 being anything from stark differences to subtle differences. It should also be noted that any phosphor referred to in this specification might actually be a mixture of 2 or more phosphors.

The carrier 104 of some embodiments may include polymeric material and phosphor materials. In some embodiments, the phosphors 105, 106 can be placed in specific locations. The phosphor locations may include a polymeric binder material combined with the phosphors 105, 106. In some embodiments, the carrier 104 can include phosphor materials 105, 106 and a polymeric binder material situated on a framework made of any sufficiently stiff material, so that the phosphors 105, 106 can be directly exposed to the light 103. In some embodiments, the phosphors may be directly molded into a plastic part that may be used as the carrier 104 and phosphors 105, 106. The phosphors 105, 106 may be situated at specific locations on or within a carrier 104 comprised of a polymer layer or film in some embodiments. The polymer layer may be formed of any useful polymer material and may transmit all or a portion of the light 103. The polymer layer may act as an interference reflector reflecting a portion of the light 103 and/or reflecting a portion of the light 107, 108 emitted by the phosphors 105, 106. In some embodiments, the polymer layer can absorb a portion of the light 103 and/or absorb a portion of the light 107, 108 emitted by the phosphors 105, 106 as desired. In some embodiments, the performance of the dual phosphor LED 100 may be increased by using polymeric multilayer optical films for the carrier 104. These polymeric multilayer optical films may have tens, hundreds, or thousands of alternating layers of at least a first and second polymer material, whose thicknesses and refractive indices are selected to achieve a desired reflectivity in a desired portion of the spectrum, such as a reflection band limited to UV wavelengths or a reflection band limited to visible wavelengths. A wide variety of polymer materials may be suitable for use in multilayer optical films. However, particularly where the dual-phosphor LED 100 comprises white-light phosphors 105, 106 coupled with a UV LED 101, the multilayer optical film may comprise alternating polymer layers composed of materials that resist degradation when exposed to UV light. In this regard, one effective polymer pair is polyethylene terephthalate (PET)/co-polymethylmethacrylate (co-PMMA). The UV stability of polymeric reflectors may also be increased by the incorporation of non-UV absorbing light stabilizers such as hindered amine light stabilizers (HALS). In some cases the polymeric multilayer optical film may also include transparent metal or metal oxide layers. In applications that use particularly high intensity UV light that could unacceptably degrade even robust polymer material combinations, it may be beneficial to use inorganic materials to form the multilayer stack. However, in some embodiments it may be convenient and cost effective for the multilayer optical film to be substantially completely polymeric, free of inorganic materials.

The embodiments disclosed herein may be operative with a variety of phosphor materials. The phosphor materials are typically inorganic in composition, with some embodiments having excitation wavelengths in the 200-475 nm range and emission wavelengths in the visible wavelength range. In the case of phosphor materials having a narrow emission wavelength range, a mixture of phosphor materials may be formulated to achieve the desired color balance, as perceived by the viewer, for example a mixture of red-, green- and blue-emitting phosphors. Phosphor materials having broader emission bands may be useful for phosphor mixtures having higher color rendition indices. A phosphor blend may comprise phosphor particles in the 1-25 μm size range dispersed in a binder such as epoxy, adhesive, or a polymeric matrix, which can then be applied to a substrate, such as a the multilayer optical film described above. Phosphors that convert light in the range of about 200 to 475 nm to longer wavelengths are well known in the art. See, for example, the line of phosphors offered by Phosphor Technology Ltd., Essex, England. Phosphors include rare-earth doped garnets, silicates, and other ceramics. The term "phosphor" as used herein can also include organic fluorescent materials, including fluorescent dyes and pigments.

Figure 2A:
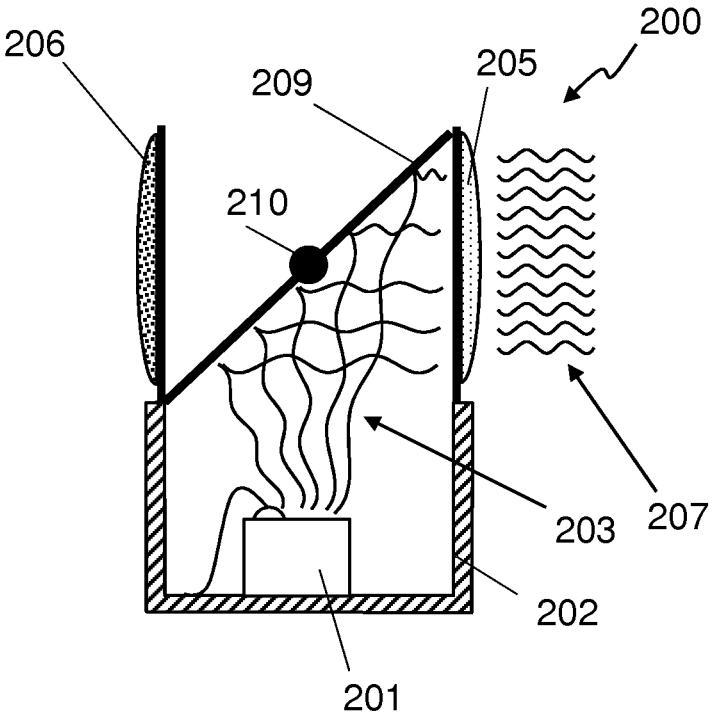
FIGS. 2A and 2B show an embodiment of a dual phosphor LED utilizing a movable mirrored surface in two different operating modes.
Figure 2B:
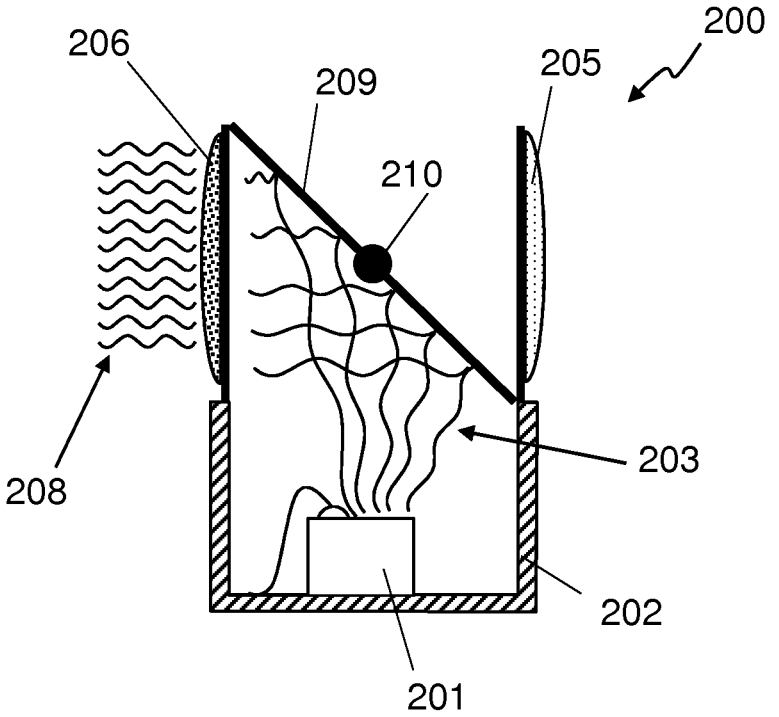

FIG. 2A shows a cross-section of an embodiment of a dual phosphor LED 200 utilizing a movable mirrored surface 209 in a first operating mode and FIG. 2B shows a cross-section of the embodiment of the dual phosphor LED 200 utilizing a movable mirrored surface 209 in a second operating mode. In the first operating mode shown in FIG. 2A, the LED 201 may be situated in the case 202 and emits light 203 at a given wavelength which is reflected by the moveable mirrored surface 209 to irradiate the first phosphor 205. The first phosphor 205 may be situated on a carrier or may be combined with a polymeric binder to give it a structure. The first phosphor emits light with a first spectral characteristic 207. In the second operating mode shown in FIG. 2B, the LED 201 may be situated in the case 202 and emits light 203 at a given wavelength which is reflected by the moveable mirrored surface 209 to irradiate the second phosphor 206. The second phosphor 206 may be situated on a carrier or may be combined with a polymeric binder to give it a structure. The second phosphor emits light with a second spectral characteristic 208. In the embodiment shown in FIGS. 2A and 2B, the moveable mirrored surface 209 may be mirrored on both sides and may pivot on an axle 210. Other embodiments may move the mirrored surface in other configurations such as rotating the mirrored surface, warping the mirrored surface, or moving the mirrored surface in a reciprocating motion. Some embodiments may use a single side of the mirrored surface. Other embodiments may utilize a multisided structure with multiple mirrored surfaces. Some embodiments may use a series of mirrors with one or more moveable mirrored surfaces. And some embodiments may use a reflector to direct the light 207, 208 emitted by the phosphors 205, 206 in the desired direction. One embodiment may use a digital micromirror device (DMD) such as a DLP® chip manufactured by Texas Instruments. Any set of optical paths using one or more mirrored surface that allow the light 203 from the LED 201 to be optically coupled to the first phosphor 205 and the second phosphor 206 may be used. A controller may also be provided to receive a selection input of the desired spectral characteristic and control the position of the moveable reflective surface 209.

Figure 3A:
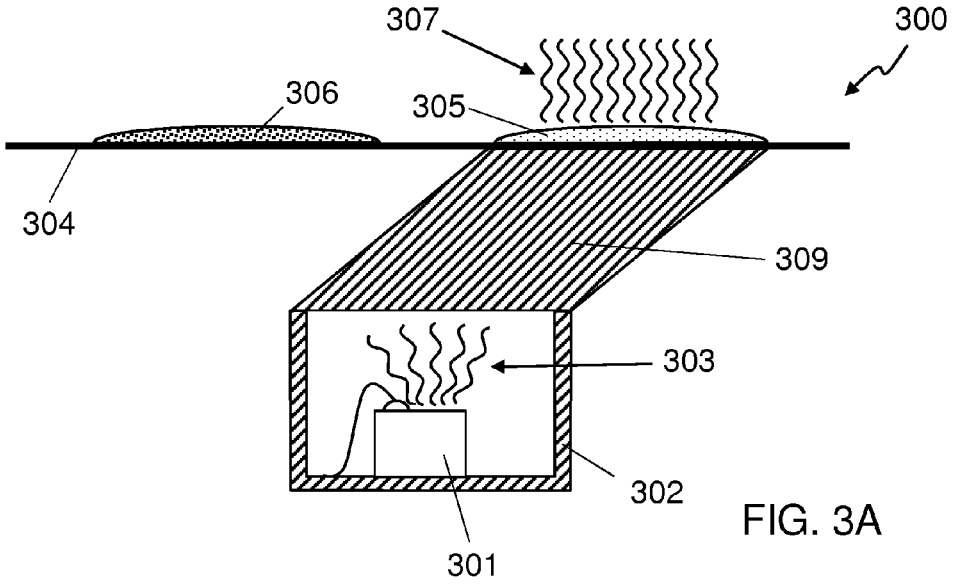
FIGS. 3A and 3B show an embodiment of a dual phosphor LED utilizing a movable light guide in two different operating modes.
Figure 3B:
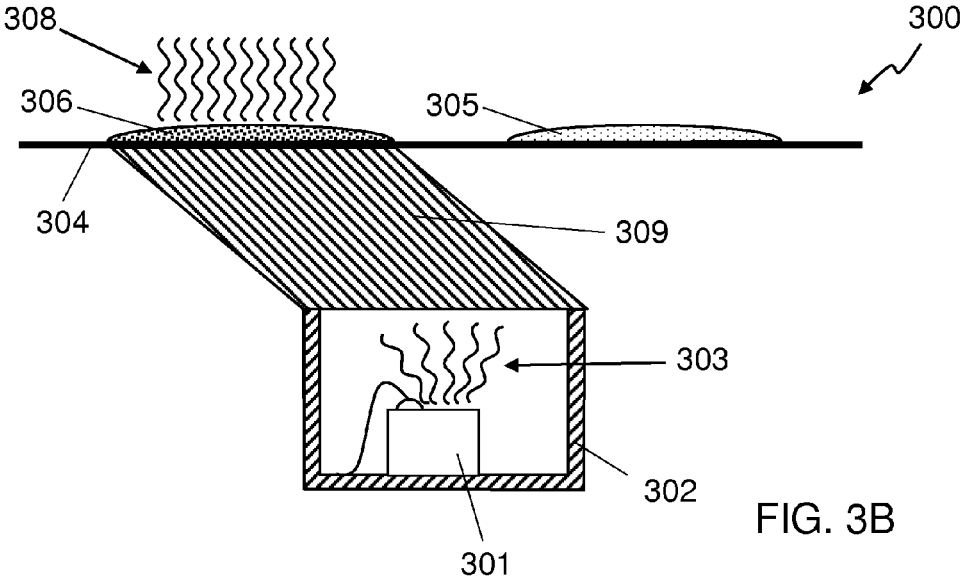

FIG. 3A shows a cross-section of an embodiment of a dual phosphor LED 300 utilizing a movable light guide 309 in a first operating mode and FIG. 3B shows a cross-section of the embodiment of the dual phosphor LED 300 utilizing a movable light guide 309 in a second operating mode. In the first operating mode shown in FIG. 3A, the LED 301 may be situated in the case 302 and emits light 303 at a given wavelength which is routed by the moveable light guide 309 to irradiate the first phosphor 305. The first phosphor 305 may be situated on a carrier 304 or may be combined with a polymeric binder to give it a structure. The first phosphor emits light with a first spectral characteristic 307. In the second operating mode shown in FIG. 3B, the LED 301 may be situated in the case 302 and emits light 303 at a given wavelength which is routed by the moveable light guide 309 to irradiate the second phosphor 306. The second phosphor 306 may be situated at a second location on the same carrier 304 or on its own carrier, or it may be combined with a polymeric binder to give it structure. The second phosphor 306 emits light with a second spectral characteristic 308. In the embodiment shown in FIGS. 3A and 3B, the moveable light guide 309 may be rigid and may pivot on an axle. Other embodiments may move the light guide in other configurations such as rotating the light guide, bending the light guide, or moving the light guide in a reciprocating motion. Some embodiments may use the same optical path through the light guide for both operating modes, simply moving the light guide 309 to optically couple the LED 301 to either the first phosphor 305 or the second phosphor 306. Other embodiments may utilize one or more light guide with multiple optical paths, using one or more optical paths to optically couple the LED 301 to the first phosphor 305 and either moving the LED 301 or the light guide to utilize at least one different optical path through the light guide to optically couple the LED 301 to the second phosphor 306. Some embodiments may utilize one or more optical fibers as the light guide. And some embodiments may use a light guide in conjunction with mirrored surfaces and/or light valves and/or light shutters to form the two operating modes. Any set of optical paths using one or more light guides that allow the light 303 from the LED 301 to be optically coupled to the first phosphor 305 and the second phosphor 306 may be used. A controller may also be provided to receive a selection input for the desired spectral characteristic and control the position of the light guide 309.

Figure 4:
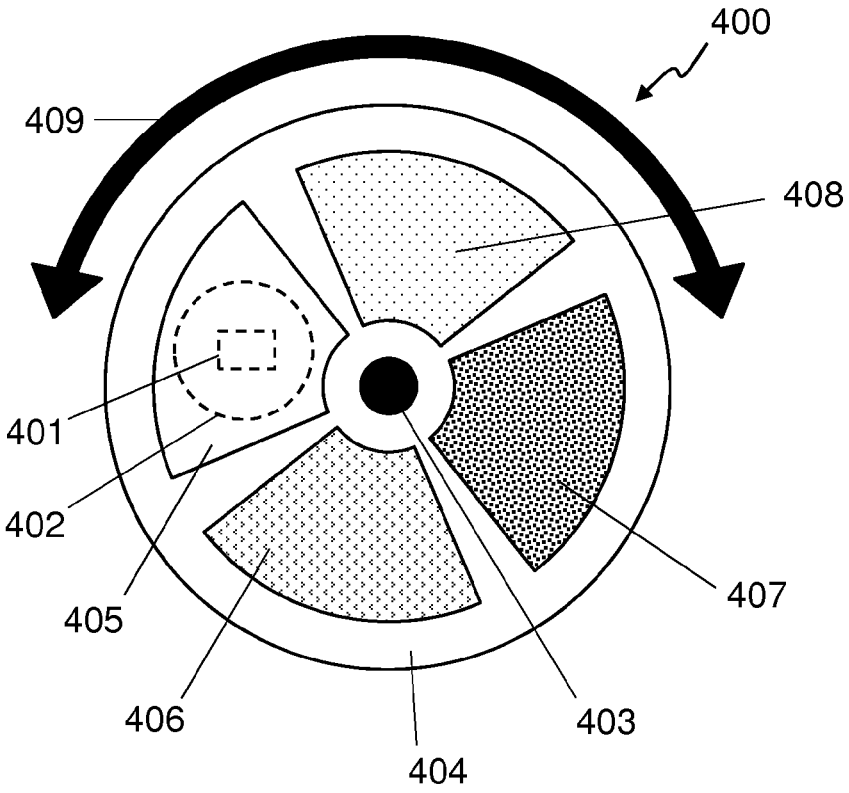
FIG. 4 shows an embodiment of a multiple phosphor LED where the phosphors are located on a carrier that is moved about an axis.

FIG. 4 shows a top view of an embodiment of a multiple phosphor LED 400 where the phosphors 405-408 are located on a carrier 404 that is rotated 409 about an axis. The LED 401 may be situated in the case 402, emitting light. Above the LED 401, a carrier 404 may be situated to allow the light emitted by the LED 401 to irradiate one of a plurality of phosphors 405-408. In one embodiment shown, the carrier 404 may have a first phosphor 405 located at a first position capable of emitting light with a first spectral characteristic when irradiated with light from the LED 401, a second phosphor 406 located at a second position capable of emitting light with a second spectral characteristic when irradiated with light from the LED 401, a third phosphor 407 located at a third position capable of emitting light with a third spectral characteristic when irradiated with light from the LED 401, and a fourth phosphor 408 located at a fourth position capable of emitting light with a fourth spectral characteristic when irradiated with light from the LED 401. The carrier 404 may rotate 409 about axis on an axle 403 allowing any one of the four phosphors 405-408 to be positioned above the LED 401 to optically couple the light from the LED 401 to one of the phosphors 405-408. As shown in FIG. 4, the first phosphor 405 is positioned above, and optically coupled to, the LED 401. The axle 403 may be coupled, in some embodiments, to a rotary motion device such as an electric motor, a ratcheting mechanism, a piezoelectric rotary actuator, a servo, a pneumatic actuator, a hydraulic actuator, a micromachine or nanomachine, or any other device capable of creating rotary motion. The axle 403 may be directly driven by the rotary motion device directly or, in some embodiments, the axle may be driven through one or more pulleys, gears or other mechanisms that allow motion to be coupled to the axle 403. In some embodiments, the axle 403 may not be driven but simply allowed to turn freely while the carrier 404 is rotated 409 by a device exerting a force on the carrier 404. In other embodiments, the carrier 404 may rotate about a fixed axle 403. Any mechanism that allows the carrier 404 to be moved in a rotating motion 409 about an axis, either clockwise, counter-clockwise, or alternatively in either direction, may be used. Other embodiments may keep the carrier 404 in a fixed position and move the LED 401. A controller may also be provided to receive a selection of the desired spectral characteristic and control the rotation 409 of the carrier 404.

Figure 5:
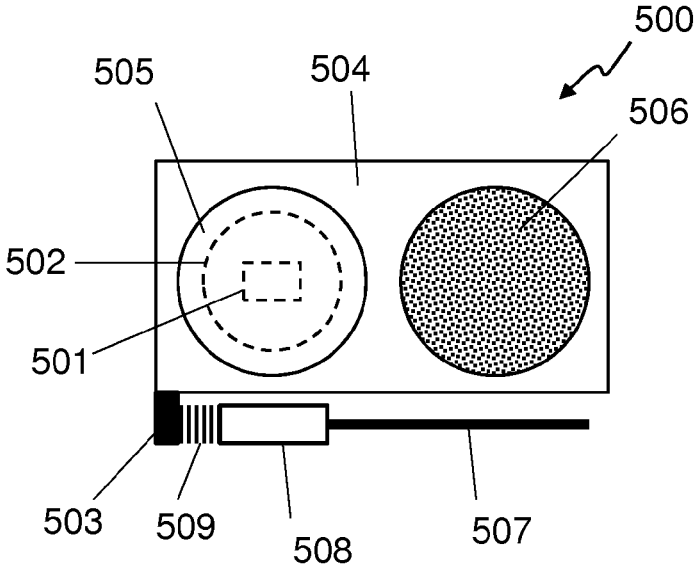
FIG. 5 shows an embodiment of a dual phosphor LED where the phosphors are located on a carrier that is moved using a solenoid in a reciprocating fashion.

FIG. 5 shows a top view of an embodiment of a dual phosphor LED 500 where the phosphors 505, 506 are located on a carrier 504 that may be moved using a solenoid 508 in a reciprocating fashion. In the embodiment shown, LED 501 may be situated in a case 502 with the carrier 504 situated immediately above the LED 501 and mounted in such a way that it may be able to slide back and forth. An attachment point 503 may be fixed to the carrier 504 with an armature 507 of the solenoid 508 fixedly attached to the attachment point. A spring 509 may be located between the attachment point 503 and the body of the solenoid 508. In the position shown in FIG. 5, the first phosphor 505 may be positioned above the LED 501 so that a first spectral characteristic light can be emitted by the dual phosphor LED 500. The carrier 504 may be kept in this position by having the solenoid 508 activated by allowing current to flow through the solenoid 508 and creating a force to draw in the armature 507 into the body of the solenoid 508, thereby compressing the spring 509. If the solenoid 508 is deactivated by shutting off the current, the force on the armature 507 may be released allowing the spring 509 to expand, pushing the attachment point 503, and thereby the carrier 504, away from the body of the solenoid 508 and causing the second phosphor 506 to be positioned above the LED 501 and a second spectral characteristic light to be emitted. A controller may also be provided to receive a selection input for the desired spectral composition and control the solenoid 508.

Figure 6:
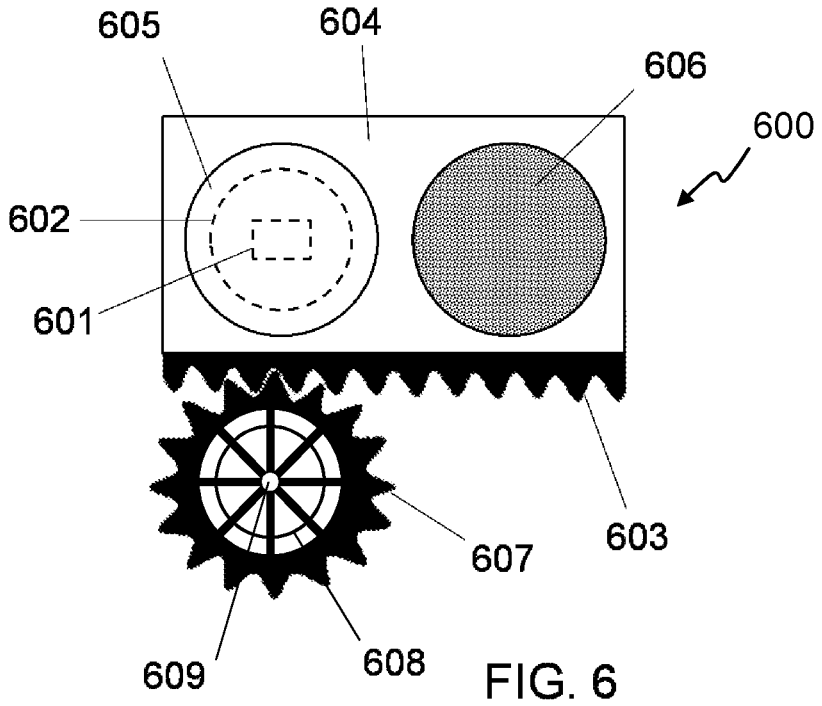
FIG. 6 shows an embodiment of a dual phosphor LED where the phosphors are located on a carrier that is moved using a rack and pinion mechanism in a reciprocating fashion.

FIG. 6 shows a top view of an embodiment of a dual phosphor LED 600 where the phosphors 605, 606 are located on a carrier 604 that is moved using a rack 603 and pinion 607 mechanism in a reciprocating fashion. In the embodiment shown, LED 601 may be situated in a case 602 with the carrier 604 situated immediately above the LED 601 and mounted in such a way that it may be able to slide back and forth. A rack 603 may be affixed to an edge of the carrier 604. In the position shown in FIG. 6, the first phosphor 605 may be positioned above the LED 601 so that a first spectral characteristic light can be emitted by the dual phosphor LED 600. To move the carrier 604, the pinion gear 607 may be rotated about its axle 609 by a motor 608. The axle 609 may be coupled, in some embodiments, to other rotary motion devices such as an electric motor, a ratcheting mechanism, a piezoelectric rotary actuator, a servo, a pneumatic actuator, a hydraulic actuator, a micromachine or nanomachine, or any other device capable of creating rotary motion. The axle 609 may be directly driven by the rotary motion device directly or, in some embodiments, the axle may be driven through one or more pulleys, gears or other mechanisms that allow motion to be coupled to the axle 609. In some embodiments, the axle 609 may not be driven but simply allowed to turn freely while the pinion gear 607 is engaged by another gear to impart rotary motion to the pinion gear 607. In other embodiments, the pinion gear 607 may rotate about a fixed axle 609. Any mechanism that allows the pinion gear 607 to be moved in a rotating motion about an axis, either clockwise, counter-clockwise, or alternatively in either direction, may be used. As the pinion gear 607 rotates, the teeth of the pinion gear 607 may engage with the teeth of the rack 603 causing the carrier 604 to be moved. To move the carrier to a position where the second phosphor 606 may be optically coupled to the LED 601, the pinion gear 607 may be rotated counter-clockwise thereby moving the carrier 604 and positioning the second phosphor 606 above the LED 501 so that a second spectral characteristic light may be emitted. A controller may also be provided to control receive an indication of the desired spectral characteristic and control the movement of the pinion gear 607.

Figure 7:
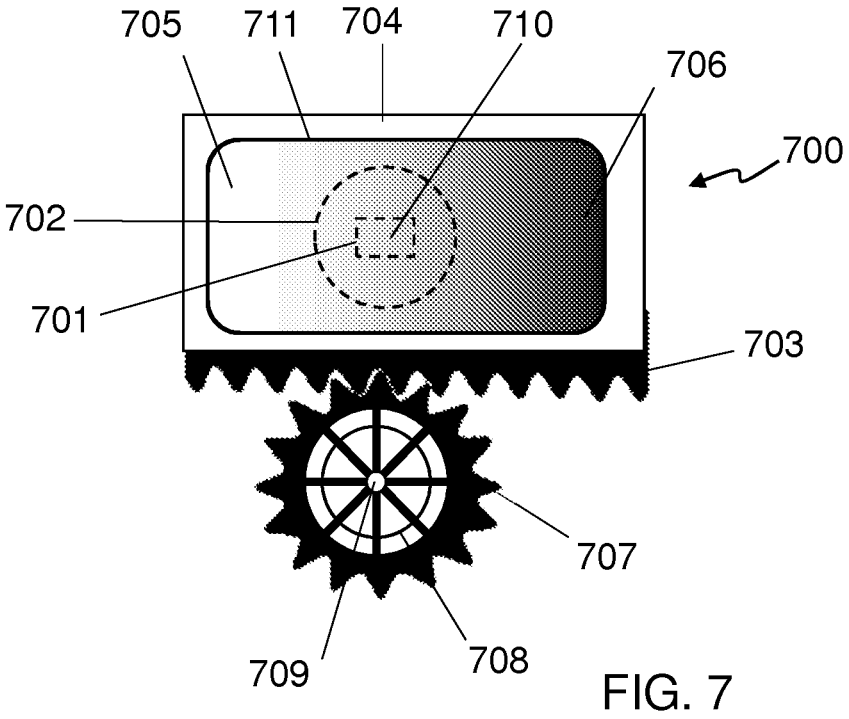
FIG. 7 shows an embodiment of a phosphor LED where the phosphor composition varies in different locations on a carrier that is moved using a rack and pinion mechanism in a reciprocating fashion.

FIG. 7 shows an embodiment of a phosphor LED 700 where the phosphor composition varies in different locations on a carrier that may be moved using a rack 703 and pinion 707 mechanism in a reciprocating fashion. In the embodiment shown, LED 701 may be situated in a case 702 with the carrier 704 situated immediately above the LED 701 and mounted in such a way that it may be able to slide back and forth. A rack 703 may be affixed to an edge of the carrier 704. To move the carrier 704, the pinion gear 707 may be rotated about its axle 709 by a motor 608 or other rotary motion device as described above. As the pinion gear 707 rotates, the teeth of the pinion gear 707 may engage with the teeth of the rack 703 causing the carrier 704 to be moved. As the carrier 704 moves back and forth over the LED 701, different portions of the phosphor area 711 may be optically coupled to the LED 701. In one embodiment a mixture or a first phosphor and a second phosphor may be used with the composition of the mixture areally varying over the phosphor area 711. Other embodiments may use three or more different phosphors mixed in a variety of ways depending on the desired optical output of the phosphor LED 700. In one embodiment a proximal end 705 of the phosphor area 711 may be deposited with a mixture that is substantially 100% the first phosphor and a distal end 706 of the phosphor area 711 may be deposited with a mixture that is substantially 100% the second phosphor. Areas between the proximal 705 and distal 706 ends may be deposited with a mixture of the two phosphors that may be dependent on the relative distance from the two ends. In one embodiment, an area 710 may be optically coupled to the LED 701 by being positioned above the LED 701. The area 710 may be approximately 45% of the way between the proximal 705 and distal 706 end. The area 710 may be deposited with a mixture of phosphors comprised of about 55% of the first phosphor and 45% of the second phosphor. Utilizing a mixture of phosphors may allow the spectrum of light emitted by the phosphor LED 700 to include the spectral characteristic of the light emissions of both the first and second phosphors. By moving the carrier 704, the relative contribution of each of the phosphors to the emitted light may be varied. A controller may also be provided to control receive an indication of the desired spectral characteristic and control the movement of the pinion gear 707.

Figure 8:
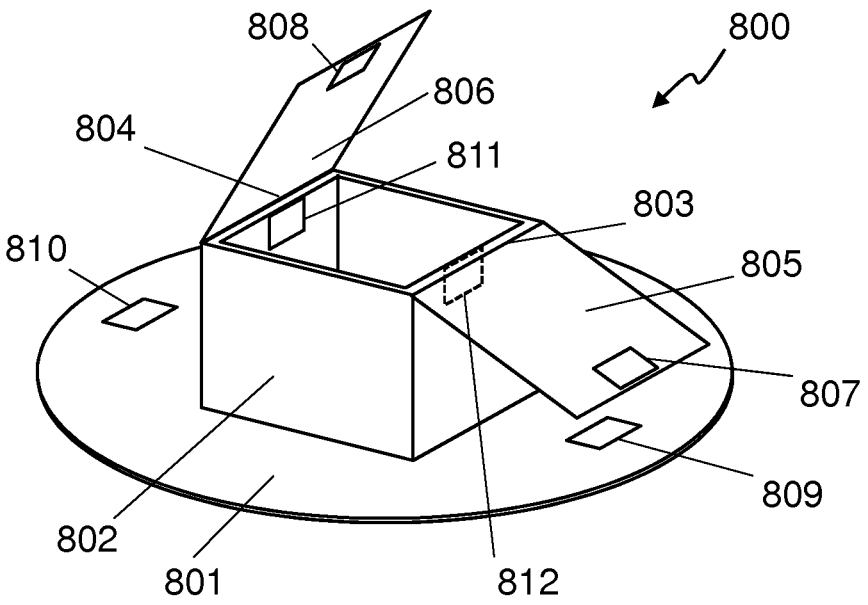
FIG. 8 shows an embodiment of a dual phosphor LED where the phosphors are located on moveable flaps.

FIG. 8 shows an embodiment of a dual phosphor LED 800 where the phosphors are located on moveable flaps 805, 806. A LED (not shown for clarity) may be situated in a case 802 that may be mounted on a base 801. A first phosphor (not shown for clarity) may be deposited on the first flap 805. The first flap 805 may be hingedly attached to the case 802. A mechanism for moving the first flap 805 may be included to close the first flap 805, thereby optically coupling the first phosphor to the LED. The mechanism also may open the first flap 805, optically decoupling the first phosphor from the LED. A second phosphor (not shown for clarity) may be deposited on the second flap 806. The second flap 806 may be hingedly attached to the case 802. A mechanism for moving the second flap 806 may be included to close the second flap 806, thereby optically coupling the second phosphor to the LED. The mechanism also may open the second flap 806, optically decoupling the second phosphor from the LED. In one embodiment as shown in FIG. 8, electrostatic forces may be used to move the flaps 805, 806. Other embodiments may use other means to move the flaps. Electrically charged areas 807-812 are positioned to move the flaps 805, 806. Charges on the electrically charged areas 807-812 may induced by electrical connections between the electrically charged areas 807-812 and a controller (not shown). Other methods to induce charge may also be used. A positive charge may be induced in a charged area 807 located on the first flap 805 and charged area 808 on the second flap 806. To open the first flap 805, a positive charge may be induced on the charged area 811 to repel the charged area 807 on the first flap 805 and a negative charge may be induced on the charged area 809 to attract the charged area 807 on the first flap 805. To close the first flap 805, a negative charge may be induced on the charged area 811 to attract the charged area 807 on the first flap 805 and a positive charge may be induced on the charged area 809 to repel the charged area 807 on the first flap 805. To open the second flap 806, a positive charge may be induced on the charged area 812 to repel the charged area 808 on the second flap 806 and a negative charge may be induced on the charged area 810 to attract the charged area 808 on the second flap 806. To close the second flap 806, a negative charge may be induced on the charged area 812 to attract the charged area 808 on the second flap 806 and a positive charge may be induced on the charged area 810 to repel the charged area 808 on the second flap 806.

Figure 9:
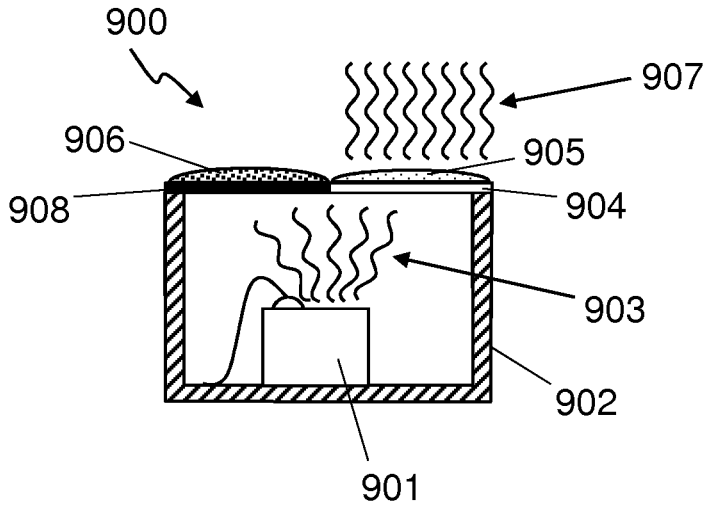
FIG. 9 shows an embodiment of a dual phosphor LED utilizing light shutters.

FIG. 9 shows an embodiment of a dual phosphor LED 900 utilizing light shutters 904, 908, light valves or other means to alternately transmit or block light. In an embodiment shown, a LED 901 may be situated in a case 902 and emit light of a particular wavelength 903. At least one light shutter may be used in some embodiments to alternately transmit or block the light 903 from reaching two or more phosphors. In an embodiment shown in FIG. 9, a first light shutter 904 may be positioned between the LED 901 and a first phosphor 905 and a second light shutter 908 may be positioned between the LED 901 and a second phosphor 906. The first light shutter 904 may be configured to transmit light at the particular wavelength 903 generated by the LED 901 allowing the first phosphor 905 to be irradiated by the light 903 from the LED 901 so that the first phosphor 905 emits light of a first spectral characteristic 907. The second light shutter 908 may be configured to block light at the particular wavelength 903 generated by the LED 901 so that the second phosphor is not irradiated by the light 903 from the LED 901 and the second phosphor emits no light. Some embodiments may utilize a liquid crystal structure as a light shutter 904, 908 wherein the incoming light may be polarized by passing through a polarizing film and then sent to a liquid crystal that may be alternatively configured as polarized in phase with the polarizing film, allowing the incoming light to pass through, or out of phase with the polarizing film blocking the light. Other embodiments may use electrochromic devices that change their opacity when an electric field is applied. Some embodiments may use transition-metal hydride electrochromics that may have the added characteristic of reflecting the light when blocking it so that the light may be re-reflected by a reflector in the case 902 to a different light shutter that may be configured to transmit the light. In another embodiment, the transition-metal hydride electrochromic material may be configured so that a first phosphor may be optically coupled to the LED when the transition-metal hydride electrochromic material is configured to transmit light, and a second phosphor may be optically coupled to the LED through a different optical path when the transition-metal hydride electrochromic material is configured to reflect light. Other embodiments may use suspended particle devices (SPDs) wherein a thin film laminate of rod-like particles are suspended in a fluid and applied to a glass or plastic substrate. Without an electric field applied to the SPD, the particles absorb the light thereby blocking it. With an electric field applied, the particles align allowing light to pass. One embodiment may use polymer dispersed light crystal devices where liquid crystals are dissolved or dispersed into a liquid polymer before the polymer is solidified. With no electric field applied, the random arrangement of the liquid crystals may block light but applying an electric field may align the liquid crystals allowing light to pass. Some embodiments may use micro-blinds composed of rolled thin metal blinds on the glass that are transparent without an applied magnetic field. Applying an electric field may cause the rolled micro-blinds to stretch out and block light. Micro-blinds are resistant to UV light. Other embodiments may use mechanical devices to act as a light shutter wherein an opaque film is inserted or removed by mechanical means to optically couple or uncouple the light from the LED 901 to a phosphor. Any device that alternatively transmits and either blocks or reflects light may be used. A controller may also be provided to control the state of the light shutters based on an input indicating a desired spectral characteristic.

Figure 10A:
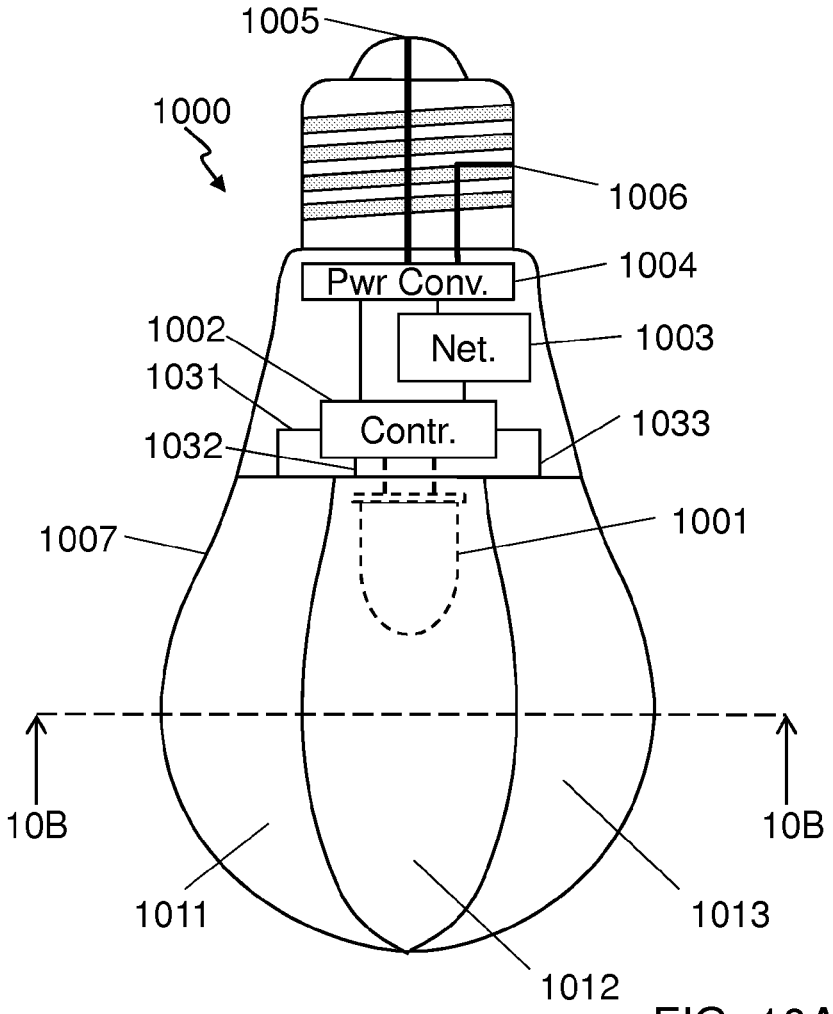
FIGS. 10A and 10B show an embodiment of a light bulb using light shutters to selectively optically couple the light from the LED to a plurality of phosphors.
Figure 10B:
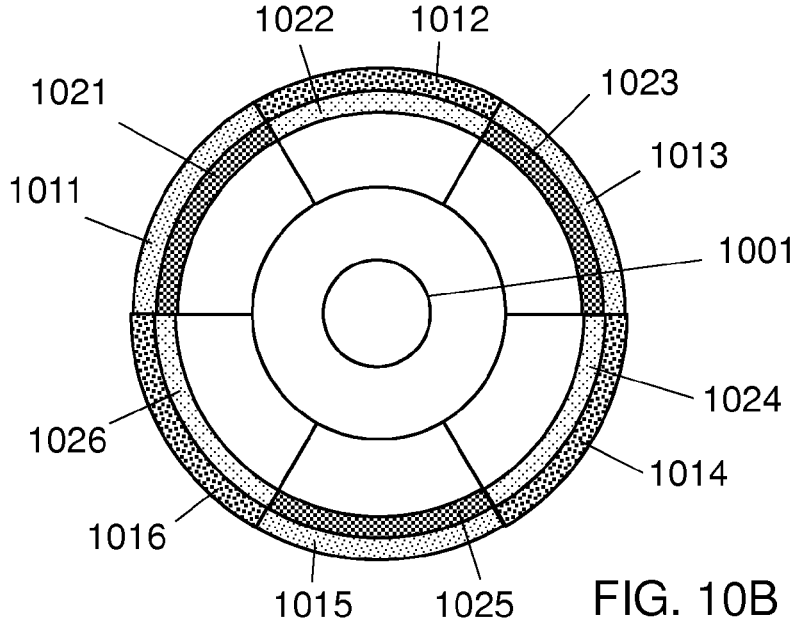

FIG. 10A shows an embodiment of a light bulb 1000 using light shutters to selectively optically couple the light from the LED 1001 to a plurality of phosphors and FIG. 10B shows a cross section of the light bulb 1000. The light bulb may have electrical connections 1005, 1006 in a base coupled to a power conversion unit 1004 to create the proper power for use in the light bulb 1000. A controller 1002 may be configured to control the LED 1001. The controller may be a microcontroller executing instructions, a finite state machine, a general purpose computer, or other electronic circuitry. A network adapter 1003 may be included for communicating to a network. In some embodiments the network may be power line network and/or may be coupled to the electrical contacts 1004, 1005. In other embodiments, the network may be a network utilizing radio frequency communication. In other embodiments, a wired network protocol or an optical network protocol may be used. Any network protocol may be utilized including, but not limited to HomePlug, Zigbee (802.15.4), ZWave, or Wi-Fi (802.11). An enclosure 1007 comprised of plastic with molded-in phosphors may enclose the LED 1001. In the embodiment shown, the enclosure 1007 may have six different sections 1011-1016. Other embodiments may have different numbers of sections and some embodiments may utilize a very large number of sections effectively creating narrow stripes phosphors. Each section 1011-1016 of the enclosure 1007 may have a different phosphor molded into the plastic of that section. An alternative embodiment may use a transparent material such as glass or plastic for the enclosure 1007 and coat the inside of the enclosure 1007 with sections of phosphor. Other embodiments may sandwich a layer of phosphors between two layers of transparent material. A light shutter 1021-1026 (as described above) is associated with each section 1011-1016 of the enclosure 1007. In some embodiments the light shutters may be integral with the enclosure 1007. In the embodiment shown in FIG. 10, the light shutters 1021-1026 are a separate layer of material or film on the inside of the enclosure 1007. Each light shutter 1021-1026 may be controlled by the controller 1002. In FIG. 10A, the controller may use control lines 1031 to control the first light shutter 1011, control lines 1032 to control the second light shutter 1012 and control lines 1033 to control the third light shutter 1013. The controller 1002 may also use other control lines to control the fourth light shutter 1014, the fifth light shutter 1015 and the sixth light shutter 1016. In some embodiments, the light shutters 1021-1026 may be controlled to substantially absorb or substantially transmit the light from the LED 1001. In another embodiment, the light shutters may be controlled to substantially reflect or substantially transmit the light from the LED 1001 which may be more efficient than absorbing the light. Either of the previous two embodiments may allow any combination of the phosphors molded into the sections to be irradiated by the light from the LED and causing the phosphors to emit their own light with their respective spectral characteristics. In other embodiments, the light shutters may be controlled to have a specific transparency to the light from the LED 1001 allowing the light from each phosphor section to be modulated. In one embodiment, alternating light shutters are controlled as a single unit with the corresponding sections of the enclosure molded with one of two phosphors so that the light bulb 1000 can be controlled to emit one of two spectral characteristics. In such an embodiment, only two phosphors may be used in alternate sections of the enclosure 1007 so that half of the sections 1011, 1013, 1015 may have the first phosphor molded into the plastic and the corresponding light shutters 1021, 1023, 1025 controlled as a single group. The other half of the sections 1012, 1014, 1016 may have the second phosphor molded into the plastic and the corresponding light shutters 1022, 1024, 1026 controlled as a single group. Then in a first operating mode, the first set of light shutters 1021, 1023, 1025 may be set to transmit light allowing light from the LED 1001 to irradiate the first phosphor embedded in the plastic of half of the sections 1011, 1013, 1015 so that the bulb emits a first spectral characteristic of light. In a second operating mode the other set of light shutters 1022, 1024, 1026 may be set to transmit light allowing light from the LED 1001 to irradiate the second phosphor embedded in the plastic of the other half of the sections 1012, 1014, 1016 so that the bulb emits a second spectral characteristic of light.

Dual phosphor or multi-phosphor LEDs as described above may have a wide range of sizes. In some embodiments, the multi-phosphor LED may be quite large, up to several hundred cubic centimeters or perhaps even larger in some embodiments such as the bulb described in FIG. 10. Other embodiments may utilize miniaturized components and be only a few centimeters on a side and up one centimeter thick. In yet other embodiments utilizing microtechnology or nanotechnology, the multi-phosphor LED may only be slightly larger than an existing LED package, or a few millimeters on a side and a couple of millimeters thick or even smaller. One embodiment might be designed to easily fit within a standard A19 light bulb which has a diameter of about 2.4 inches. So one embodiment may be built to fit in a cylindrical shape of less than about 2 inches in diameter and less than about 1 inch high.

Figure 11:
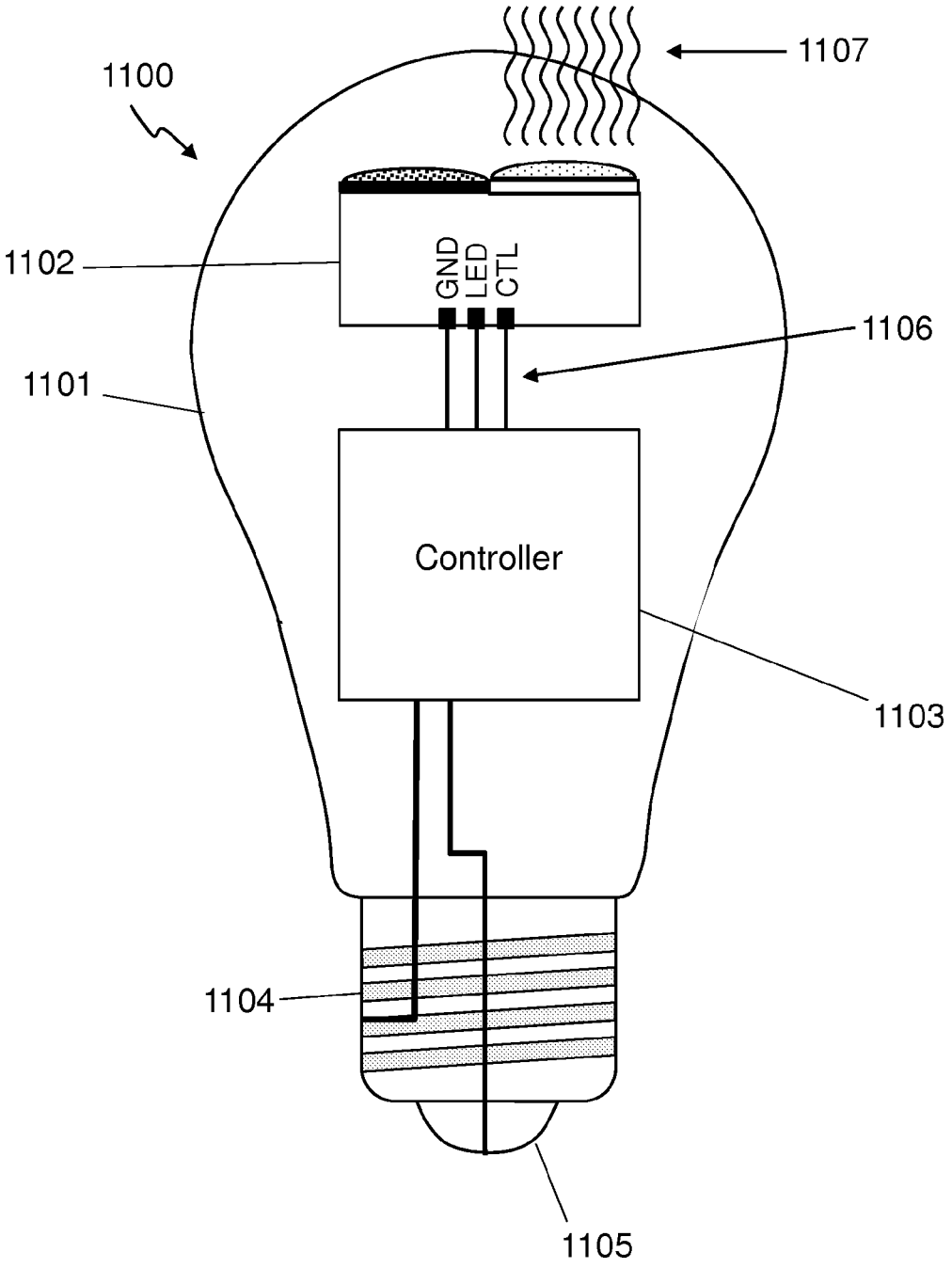
FIG. 11 shows an embodiment of a light bulb using a dual phosphor LED.

FIG. 11 shows an embodiment of a light bulb 1100 using a dual phosphor LED 1102. Any embodiment of a multiple phosphor LED 1102 may be used including, but not limited to, the embodiments described herein. An enclosure 1101 may be attached to a base with electrical contacts 1104, 1105. A controller 1103 may be incorporated in the light bulb 1100. The controller 1103 may receive power by being coupled to the electrical contacts 1104, 1105. The controller 1103 may also receive communication from devices outside of the light bulb 1100. In some embodiments the communication may be received from a power line network that may utilize radio frequency communication techniques and/or may be coupled to the electrical contacts 1104, 1105. In other embodiments, the communication may come from radio frequency signals received from an antenna. In other embodiments, a wired communication protocol may be coupled to the controller 1103 and in yet additional embodiments, optical communication techniques may be used to receive communications. Any communications protocol may be utilized for communications including, but not limited to HomePlug, Zigbee (802.15.4), ZWave, or Wi-Fi (802.11). In some embodiments the light bulb 1100 may have a user interface comprising buttons, knobs, switches or other user manipulatable controls. In many embodiments the communication received by the controller 1103 may comprise an operating mode request. In some embodiments, the request may explicitly identify the desired operating mode. In other embodiments, the operating mode may be implicitly identified by the request if the request is for a specific color, a specific spectral characteristic of light, or a next type of light in a sequence of circular queue of operating modes. Once the controller 1103 has received the request, it determines which operating mode to select. The controller then utilizes the communication path 1106, which may be comprised of a plurality of individual communication connections and/or power connections, to the dual phosphor LED 1102. Both power and control wires may be used in the communication path 1106 to couple the dual phosphor LED 1102 to the controller 1103. Once the controller 1103 has put the dual phosphor LED 1102 into the desired operating mode, light with the selected spectral composition 1107 may be emitted by the light bulb 1100.

The light bulb 1100 may be of any size or shape. It may be a component to be used in a light fixture or it may be designed as a stand-alone light fixture to be directly installed into a building or other structure. In some embodiments, the light bulb may be designed to be substantially the same size and shape as a standard incandescent light bulb. Although there are far too many standard incandescent bulb sizes and shapes to list here, such standard incandescent light bulbs include, but are not limited to, "A" type bulbous shaped general illumination bulbs such as an A19 or A21 bulb with an E26 or E27, or other sizes of Edison bases, decorative type candle (B), twisted candle, bent-tip candle (CA & BA), fancy round (P) and globe (G) type bulbs with various types of bases including Edison bases of various sizes and bayonet type bases. Other embodiments may replicate the size and shape of reflector (R), flood (FL), elliptical reflector (ER) and Parabolic aluminized reflector (PAR) type bulbs, including but not limited to PAR30 and PAR38 bulbs with E26, E27, or other sizes of Edison bases. In other cases, the light bulb may replicate the size and shape of a standard bulb used in an automobile application, most of which utilize some type of bayonet base. Other embodiments may be made to match halogen or other types of bulbs with bi-pin or other types of bases and various different shapes. In some cases the light bulb 1100 may be designed for new applications and may have a new and unique size, shape and electrical connection.

Figure 12:
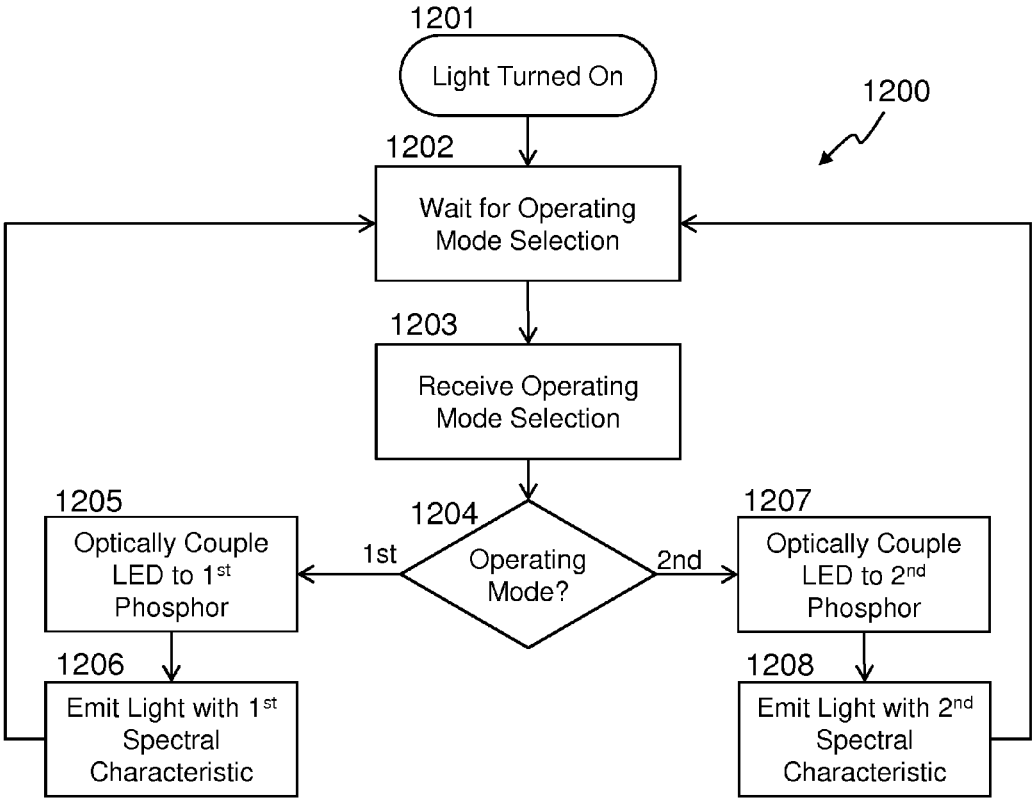
FIG. 12 shows a flow chart for an embodiment of a method for generating different spectral compositions of light.

FIG. 12 shows a flow chart 1200 for an embodiment of a method for generating different spectral compositions of light. The light may be turned on at block 1201 and a controller then waits for an operating mode selection at block 1202. An operating mode selection is received at block 1203 and evaluated a block 1204. The operating mode selection may be an explicit command to choose a particular operating mode or the operating mode may be implicitly defined based on a selection of a color or a request for a particular spectral composition. The operating mode selection may be received using radio frequency communication, baseband communication, optical communication, or other communication methods. Radio frequency communication may be received from an antenna or over a wire such as the power line. A plurality of operating modes may be supported but one embodiment may have two different operating modes. If a first operating mode is selected, a first phosphor may be optically coupled to an LED in block 1205 and light with a first spectral characteristic emitted in block 1206 followed by waiting for another operating mode selection in block 1202. If a second operating mode is selected, a second phosphor may be optically coupled to an LED in block 1207 and light with a second spectral characteristic emitted in block 1208 followed by waiting for another operating mode selection in block 1202. Once an operating mode is selected, it may remain in place for minutes, hours, days or even longer as the light may be used for illumination purposes and not for simply for a short period of time as would be used for a simple analysis of the spectral content.

Since the LED dies may constitute a large majority of the cost of an LED lamp today, the embodiments described herein may provide a very cost advantageous solution over embodiments using a separate LED die for each desired spectral characteristic output. Another advantage of the embodiments described herein is that the thermal solution may be significantly simpler than a multi-die thermal solution. Because there may be only a single die or small grouping of dies that are powered on independent of the current spectral output, only one thermal solution need be provided while solutions using multiple LED dies may require multiple thermal solutions thereby further increasing their cost.

Unless otherwise indicated, all numbers expressing quantities of elements, optical characteristic properties, and so forth used in the specification and claims are to be understood as being modified in all instances by the term "about." Accordingly, unless indicated to the contrary, the numerical parameters set forth in the preceding specification and attached claims are approximations that can vary depending upon the desired properties sought to be obtained by those skilled in the art utilizing the teachings of the present invention. At the very least, and not as an attempt to limit the application of the doctrine of equivalents to the scope of the claims, each numerical parameter should at least be construed in light of the number of reported significant digits and by applying ordinary rounding techniques. Notwithstanding that the numerical ranges and parameters setting forth the broad scope of the invention are approximations, the numerical values set forth in the specific examples are reported as precisely as possible. Any numerical value, however, inherently contains certain errors necessarily resulting from the standard deviations found in their respective testing measurements.

The recitation of numerical ranges by endpoints includes all numbers subsumed within that range (e.g. 1 to 5 includes 1, 1.5, 2, 2.75, 3, 3.80, 4, and 5).

As used in this specification and the appended claims, the singular forms "a", "an", and "the" include plural referents unless the content clearly dictates otherwise. Thus, for example, reference to an element described as "an LED" may refer to a single LED, two LEDs or any other number of LEDs. As used in this specification and the appended claims, the term "or" is generally employed in its sense including "and/or" unless the content clearly dictates otherwise.

Any element in a claim that does not explicitly state "means for" performing a specified function, or "step for" performing a specified function, is not to be interpreted as a "means" or "step" clause as specified in 35 U.S.C. §112, ¶ 116. In particular the use of "step of" in the claims is not intended to invoke the provision of 35 U.S.C. §112, ¶ 116.

The description of the various embodiments provided above is illustrative in nature and is not intended to limit the invention, its application, or uses. Thus, variations that do not depart from the gist of the invention are intended to be within the scope of the embodiments of the present invention. Such variations are not to be regarded as a departure from the intended scope of the present invention.

What is claimed is:

1. A light bulb comprising:

a LED to emit light at a wavelength;

a first phosphor to radiate light with a first spectral characteristic out of the light bulb in response to irradiation by the light at the wavelength;

a second phosphor to radiate light with a second spectral characteristic out of the light bulb in response to irradiation by the light at the wavelength;

a first light shutter, controlled by a first electromagnetic field, fixedly interposed between the LED and the first phosphor;

a second light shutter, controlled by a second electromagnetic field, fixedly interposed between the LED and the second phosphor;

electronic circuitry to generate the first electromagnetic field and the second electromagnetic field;

an enclosure at least partially surrounding the LED and the electronic circuitry; and a connector attached to the enclosure and electrically coupled to a power input of the electronic circuitry;

wherein the electronic circuitry is configured to receive an operating mode selection; and in response to receiving a first selection as the operating mode selection, control the first electromagnetic field to set a state of the first light shutter to optically couple the LED to the first phosphor, and control the second electromagnetic field to set a state of the second light shutter to optically decouple the LED from the second phosphor; and in response to receiving a second selection as the operating mode selection, control the second electromagnetic field to set the state of the second light shutter to optically couple the LED to the second phosphor.

2. The light bulb of claim 1, wherein the enclosure has substantially the same size and shape as a typical incandescent light bulb, and the connector comprises an Edison screw fitting base.

3. The light bulb of claim 1, wherein the first light shutter and the second light shutter comprise electrochromic material.

4. The light bulb of claim 1, wherein the first light shutter comprises a layer of material coupled to an inside surface of a first portion of the enclosure;

the second light shutter comprises a layer of material coupled to an inside surface of a second portion of the enclosure.

5. The light bulb of claim 4, wherein the first phosphor is molded into the first portion of the enclosure, and the second phosphor is molded into the second portion of the enclosure.

6. The light bulb of claim 4, wherein the first phosphor comprises a layer of material positioned between the layer of material coupled to the inside surface of the first portion of the enclosure and the first portion of the enclosure; and the second phosphor comprises a layer of material positioned between the layer of material coupled to the inside surface of the second portion of the enclosure and the second portion of the enclosure.

7. The light bulb of claim 1, wherein the LED comprises a semiconductor laser diode.

8. The light bulb of claim 1, wherein the light at the wavelength comprises coherent light.

9. A light emitting apparatus comprising:

a light emitting device, fixedly situated at a first position within the light emitting apparatus, to emit light at a wavelength;

a first phosphor, fixedly situated at a second position within the light emitting apparatus, to radiate light with a first spectral characteristic out of the light emitting apparatus in response to irradiation by the light at the wavelength;

a second phosphor, fixedly situated at a third position within the light emitting apparatus, to radiate light with a second spectral characteristic out of the light emitting apparatus in response to irradiation by the light at the wavelength;

a first optical coupling mechanism positioned to optically couple the light emitting device to the first phosphor in a first operating mode and optically decouple the light emitting device from the first phosphor in a second operating mode; and a second optical coupling mechanism positioned to optically couple the light emitting device to the second phosphor in the second operating mode and optically decouple the light emitting device from second phosphor in the first operating mode.

10. The light emitting apparatus of claim 9, wherein the light emitting device comprises a laser.

11. The light emitting apparatus of claim 9, wherein the light emitting device comprises one or more LEDs.

12. The light emitting apparatus of claim 9, wherein the light at the wavelength comprises coherent light.

13. The light emitting apparatus of claim 9, further comprising electronic circuitry configured to:

receive a selection input to select either the first operating mode or the second operating mode; and control the first optical coupling mechanism and the second optical coupling mechanism based on the selection input.

14. The light emitting apparatus of claim 13, the first optical coupling mechanism comprising a movable light guide under control of the electronic circuitry, the moveable light guide moved to a first position in the first operating mode, and a second position in the second operating mode.

15. The light emitting apparatus of claim 13, the first optical coupling mechanism comprising a movable reflective surface under control of the electronic circuitry, the movable reflective surface moved to a first position in the first operating mode, and a second position in the second operating mode.

16. The light emitting apparatus of claim 13, the first optical coupling mechanism comprising at least one light shutter in a fixed position under control of the electronic circuitry, the at least one light shutter having a first state in the first operating mode, and a second state in the second operating mode.

17. The light emitting apparatus of claim 16, wherein the electronic circuitry is further configured to generate an electromagnetic field to control the at least one light shutter;

wherein a state of the electromagnetic field is dependent upon the selection input, and the state of the electromagnetic field determines whether the at least one light shutter is in the first state or the second state.

18. The light emitting apparatus of claim 16, wherein the at least one light shutter comprises electrochromic material.

19. The light emitting apparatus of claim 9, wherein the light emitting apparatus is substantially the same size and shape as a typical incandescent light bulb.

* * * * *